US007052203B2

(12) United States Patent
Scherer

(10) Patent No.: US 7,052,203 B2
(45) Date of Patent: May 30, 2006

(54) SURFACING STRUCTURE FOR TRAFFIC AREAS AND FOR SURFACES OF STRUCTURES

(76) Inventor: Joseph Scherer, Alte Kantonsstrasse 16, Brunnen (CH) CH-6440

( * ) Notice: Subject to any disclaimer, the term of this patent is extended or adjusted under 35 U.S.C. 154(b) by 0 days.

(21) Appl. No.: 10/479,068

(22) PCT Filed: May 28, 2002

(86) PCT No.: PCT/EP02/05851

§ 371 (c)(1),
(2), (4) Date: Oct. 12, 2004

(87) PCT Pub. No.: WO03/002821

PCT Pub. Date: Jan. 9, 2003

(65) Prior Publication Data

US 2005/0047863 A1 Mar. 3, 2005

(30) Foreign Application Priority Data

May 29, 2001 (DE) ..... 101 26 074

(51) Int. Cl.
*E01C 11/16* (2006.01)

(52) U.S. Cl. ..... 404/82; 404/72; 404/79

(58) Field of Classification Search ..... 404/17, 404/18, 27, 28, 31, 32, 35, 36, 42, 70, 134, 404/82, 72, 75, 79; 52/309.16; 442/59
See application file for complete search history.

(56) References Cited

U.S. PATENT DOCUMENTS 2,539,420 A * 1/1951 Hazeltine, Jr. et al. ..... 428/202
3,300,211 A * 1/1967 Maring ..... 473/504
4,617,219 A * 10/1986 Schupack ..... 428/113
5,836,715 A * 11/1998 Hendrix et al. ..... 404/134

FOREIGN PATENT DOCUMENTS

DE 4123055 A1 * 1/1993
EP 1094171 A2 * 4/2001
FR 2713253 A3 * 6/1995

* cited by examiner

*Primary Examiner*—Thomas B. Will
*Assistant Examiner*—Alexandra Pechhold
(74) *Attorney, Agent, or Firm*—Stevens, Davis, Miller & Moser,LLP

(57) ABSTRACT

The invention relates to a surfacing structure for traffic areas and for surfaces of structures, which has a substructure located on the base of the surfacing and has a superstructure, which covers the latter and is comprised, at least in part, of concrete, sepecially asphaltic concrete. The substructure comprises at least one lattice work extending along the surfacing and having a number of strips, which intersect while forming a mesh, consist of high strength fiber billets with different tensile E-moduli, and which are interconnected with material fit or in a non-positive manner. A thermally removable covering can be applied to at least one surface of the lattice work.

4 Claims, 2 Drawing Sheets

B
S2
S1
K2
FS
VM
GW
OB
K1
FS
UG
UB

VM
H1
FS
UG
UB

OB
VM
BD
GS
RK
BR
UG

SURFACING STRUCTURE FOR TRAFFIC AREAS AND FOR SURFACES OF STRUCTURES

The invention relates to a surfacing structure for traffic areas and for surfaces of structures which have a substructure mounted on the base of the surfacing and a superstructure covering the latter and consisting at least in part of concrete, asphalt concrete in particular. The substructure comprises at least one latticework extending along the surfacing with a plurality of intersecting sheaves forming a mesh of high-strength strands of fiber interconnected by material retention or force locking. The invention also comprises special fiber skein latticeworks as such and structural members for surfacing structures of the type referred to.

BACKGROUND OF THE INVENTION

Surfacing structures such as this are known in the state of the art. In these structures there is present in the area of the mesh openings of the substructure matted material that is, a high-bulk fiber material, the purpose of which is to produce a surface-covering connection between the base and superstructure or its fiber skeins and cover layers. In practical application the matted fabric comes into contact with viscous bitumen when the latticework is introduced and tends to adhere to the rollers or vehicle wheels during application by roller and intermittent passage over it of construction vehicle wheels. The result is undesirable adhesion and displacement, even tearing out, of the matted material and occasionally also of the latticework connected to it.

SUMMARY OF THE INVENTION

Consequently, the object of the invention is development of a surfacing structure which, while retaining the advantages of high-strength fiber structures in the surfacing substructure, makes it possible to overcome the disadvantages indicated in the foregoing associated with adhesion and lifting or tearing out or displacement of matted fiber material covering the surface. The object claimed for the invention is attained, in conjunction with the generic characteristics indicated in the foregoing, in that the fiber skeins themselves of the latticework are saturated with a viscoplastic bonding compound and/or are enclosed in it and, as a result of this enclosing or saturation, are materially retained directly by each other in the area of their points of intersection and by the base and by the superstructure, and in that the superstructure is retained by material retention or positive locking by the base of the surfacing at least is some sections in the area of the open mesh interiors of the latticework.

This solution is based on the surprising finding, but one supported by practical application, that the fiber skeins themselves saturated with and/or enclosed in a viscoplastic bonding compound form with the base on one side and the superstructure on the other a bond stable enough to absorb the bending and tensile stresses to which the surfacing is subjected and to ensure the necessary carrying capacity of the surfacing.

In the context of the invention particular importance is assigned to the direct shear connection, of large area in the aggregate, between superstructure and base within the area of the open mesh interiors. This shear connection may be produced efficiently by material retention and/or positive locking by means of bonding agents customarily present, bituminous materials in particular, in any event in the area of the bottom of the superstructure.

Material retention may in this context be formed by adhesive or bonding action of the bonding compound on the solids affected, but positive locking by macroscopic or microscopic interlocking action.

An important development of the invention is represented by the fact that there are provided in the latticework at least two intersecting sheaves of high-strength with at least partly different tensile moduli of elasticity. This permits adaptation to all assigned load application relationships on the surfacing, as well as cost reduction with respect to the surfacing components. A structure in which at least one sheaf of fiber skeins with a relatively high tensile modulus of elasticity is mounted at an acute angle, and in particular at least approximately in one main direction of load movement is considered especially for traffic areas subjected to moving loads. Optimization of material costs may be achieved in this way for an assigned carrying capacity or service life of the surfacing. As a further development of the invention a configuration may be used for this purpose in which there are mounted in the latticework at least two intersecting sheaves of high-strength fiber skeins which in one of these skeins consist at least to some extent of glass fibers and in the other skein at least to some extent of carbon fibers.

The latticework provided in the surfacing as claimed for the invention with intersecting sheaves of high-strength fiber skeins of different tensile moduli of elasticity represents as a component an independent commercial product and accordingly a subject of a claim of its own. This applies also to the mounting of glass and carbon fibers in a latticework already mentioned in a structural context.

Another object of the invention is a prefabricated structural component in which a removable covering, a suitable layer in particular, one not bonding with and/or not adhering to and/or repelling the bonding compound is provided at least on one surface of the latticework or of the fiber skeins saturated with and/or enclosed in a viscoplastic bonding compound. This development of the invention is of considerable importance in that it makes possible a commercial product in the form of a compact coiled element. It also facilitates in situ application by simple rolling out. Something which represents particular progress in this context is development of the covering as thermally removable, as burn-off sheeting in particular. This results in further rationalization of the surfacing operations.

BRIEF DESCRIPTION OF THE DRAWINGS

The invention is described in detail in what follows with reference to one embodiment illustrated in the drawings, in which.

DETAILED DESCRIPTION OF THE INVENTION

Figure 1:
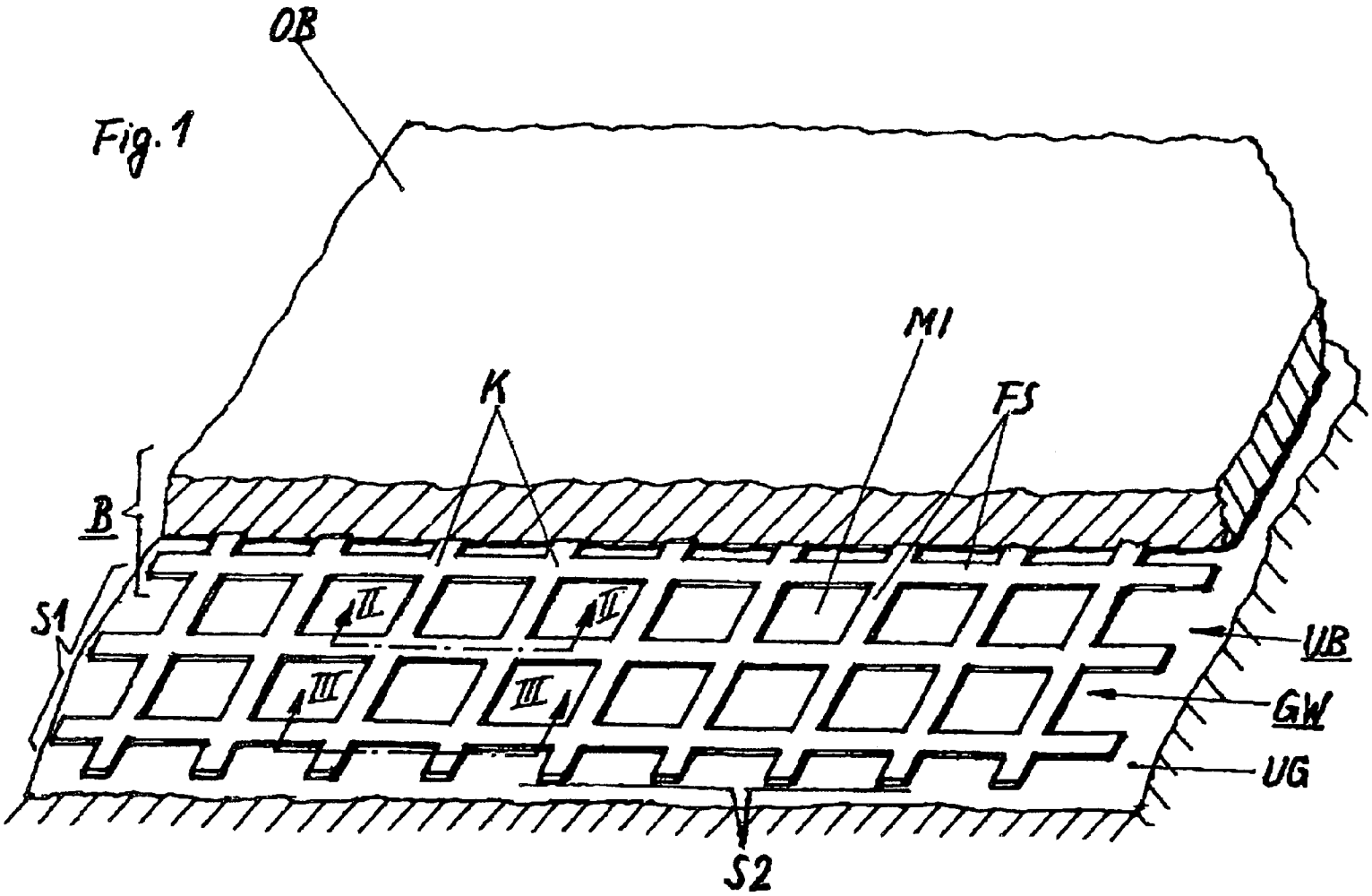
FIG. 1 presents a perspective view of a partial section of street surfacing as claimed for the invention in situ, FIG. 2 a vertical section through street surfacing as shown by sectional view II—II presented in FIG. 1, but with the superstructure already present in the area of the section, FIG. 3 a vertical section of street surfacing similar to that in FIG. 2, but as shown by sectional view III—III presented in FIG. 1, again with superstructure already present in the area of the section, and FIG. 4 a prefabricated surfacing structural element as claimed for the invention in the form of a coiled element in a side view, in an installation process indicated in diagram form.

The surfacing structure shown in FIG. 1 comprises a substructure UB mounted on the base UG of the surfacing B and a superstructure OB covering the latter and consisting at least in part of concrete, asphalt concrete in particular. The substructure comprises a latticework GW extending along the surfacing with a plurality of intersecting sheaves S1, S2 of high-strength fiber skeins FS to form meshes. The latter are interconnected at the intersections K by material retention or force locking. The fiber skeins FS themselves are saturated with and/or enclosed in a viscoelastic bonding compound, in particular a bituminous such compound, and as a result are retained by material directly both by the base UG and by the superstructure OB. The superstructure OB is connected in the area of the open mesh interiors MI of the latticework GW to the base UG of the surfacing B by material retention or positive locking, in the aggregate over a large area.

A particular technical advance is achieved in another configuration of the invention when use is made of a bonding compound thermoplastic to the state of fusion, a bituminous compound in particular, which at least to some extent fills the gaps between fibers inside the fiber skeins.

Figures 2, 3, 4:
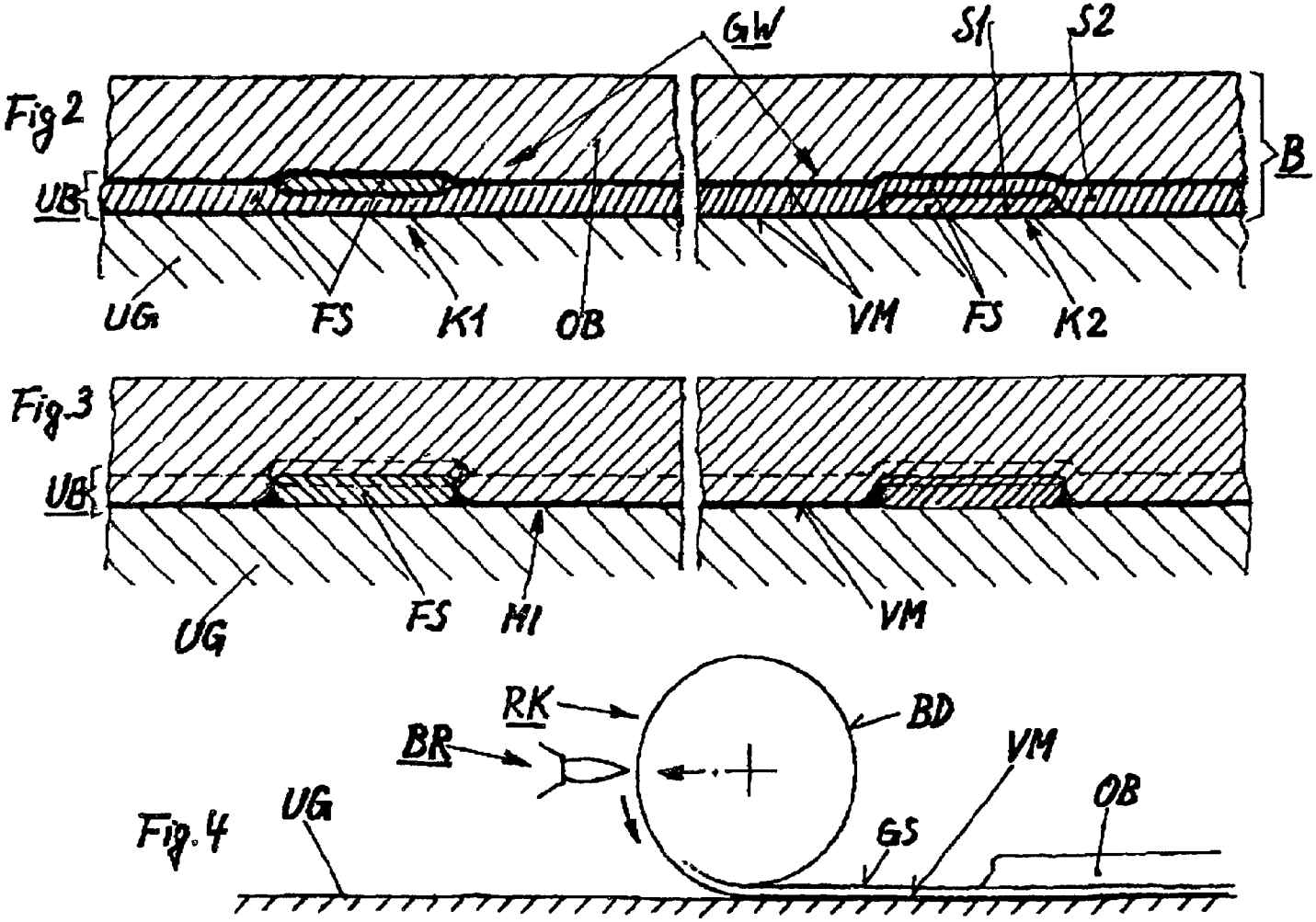

FIG. 2 shows, mounted in that latticework GW, two intersecting sheaves S1, S2 of high-strength fiber skeins FS with flat rectangular cross-section the flat sides of which extend more or less in parallel with the base. The sectional view presented of the intersections K1 and K2 indicates that a fabric structure is employed in this latticework. At the intersections the fiber skeins are interconnected by material retention or positive locking by a suitable bonding compound, optionally also a curing of such compound VM, so that substructure UB transmitting tensile forces in both directions is obtained in conjunction with base and superstructure.

It is claimed for the invention that by preference high-strength fiber skeins with tensile moduli of elasticity differing at least to some extent may be provided for the sheaves mounted in this latticework. Structures optimum from the viewpoint of stability and cost-management may be defined in this way. A sheaf of fiber skeins with relatively higher tensile modulus of elasticity is mounted preferably at an acute angle to, in particular approximately along, a primary direction of load movement. The tensile modulus of elasticity selected for the more tension-rigid fiber skeins in this instance falls within the range of 180 $kN/mm^2$ to 260 $kN/mm^2$, while the tensile modulus of elasticity selected for the more tension-flexible fiber skeins falls within the range of 60 $kN/mm^2$ to 80 $kN/mm^2$. Structures of especially high quality are obtained if there are provided in the latticework at least two intersecting sheaves of high-strength fiber skeins which in one of these sheaves consist at least in part of glass fibers and in the other sheaf at least in part of carbon fibers.

The dimensions of the lattice meshes are also of importance for an optimum sheaf configuration. The following recommended values have been found to be of value for this purpose. The minimum diameter of the open mesh interiors of the latticework should be at least about 10 mm, but the maximum diameter a maximum of about 80 mm, in particular a maximum of about 50 mm. In this connection the maximum diameter of the fiber skeins should be 3 to 10 mm, in particular up to about 5 mm.

These specified dimensions also provide reliable extension of the still ductile and accordingly not yet cured superstructure over the open interior mesh areas of the latticework to the substructure and thus ultimately provide secure fastening of the superstructure against separating, shearing, and bending stresses.

FIG. 4 illustrates a surfacing structural element as claimed for the invention configured as a coiled element RK, with layers of flat lattice material not adhering to each other. For this purpose a removable covering BD not adhering to or repelling the bonding compound, in particular one in the form of a suitable coating, is provided on at least one surface of the latticework and accordingly the fiber skeins saturated with and/or enclosed in the viscoelastic bonding compound. It is claimed for the invention that by preference this coating is configured as a thermally removable sheeting, especially one which may be burnt off. In this connection a flaming device having a burner BR is shown diagrammatically in FIG. 4. As is indicated by arrows indicating the progress of movement or operation, this design permits logical conduct of the process, along with continuous progress of the operation. An essential development of the invention with respect to the structural component consists in this context of the circumstance that a removable covering BD of the kind specified in the foregoing is provided on one surface of the latticework and a granulate coating GS not adhering to or repelling the bonding compound VM is provided on the other surface.

What is claimed is:

1. A method for surfacing a structure for traffic areas comprising:

mounting a substructure on a base of a surfacing;

covering the substructure with a superstructure, the substructure comprising asphalt concrete, at least one latticework with a plurality of intersecting sheaves of high-strength fiber skeins bonded to each other by one of material retention and force locking to form meshes having interiors and intersections, saturating the fiber skeins with and/or enclosing the fiber skeins in a viscoelastic compound and wherein the fiber skeins are joined directly at the intersections to each other and to the base and to the superstructure by such saturation or enclosure; and bonding the superstructure at least in individual sections in the mesh interiors of the latticework to the base of the surfacing by material retention and/or positive locking comprising the steps of:

providing a thermally removable sheet not adhering to or repelling the viscoelastic compound on at least one surface of the latticework or of the fiber skeins, removing the thermally removable sheet prior to joining the latticework to the base of the surfacing.

2. The method as claimed in claim 1, wherein the sheet is a burn-off sheet.

3. The method as claimed in claim 1, wherein the removable sheet is provided on one surface of the latticework and a granulate coating is provided on the another surface of the latticework, said granulate coating not adhering to or repelling the viscoelastic compound.

4. The method as claimed in claim 1, wherein said removing step comprises applying flaming device to the thermally removable sheet.

* * * * *